US007209090B2

(12) United States Patent
Hall et al.

(10) Patent No.: US 7,209,090 B2
(45) Date of Patent: Apr. 24, 2007

(54) HIGH EFFICIENCY CORE ANTENNA AND CONSTRUCTION METHOD

(75) Inventors: Stewart E. Hall, Wellington, FL (US); Brent F. Balch, Fort Lauderdale, FL (US); Richard L. Copeland, Lake Worth, FL (US); William Farrell, West Palm Beach, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 73 days.

(21) Appl. No.: 10/855,203

(22) Filed: May 27, 2004

(65) Prior Publication Data

US 2004/0252068 A1 Dec. 16, 2004

Related U.S. Application Data

(60) Provisional application No. 60/478,943, filed on Jun. 16, 2003.

(51) Int. Cl.
*H01Q 7/08* (2006.01)

(52) U.S. Cl. ..... 343/788; 343/787

(58) Field of Classification Search ..... 343/788, 343/787, 867, 895

See application file for complete search history.

(56) References Cited

U.S. PATENT DOCUMENTS

| | | | | |
|---|---|---|---|---|
| 3,750,180 | A * | 7/1973 | Fujimoto et al. | 343/788 |
| 4,760,394 | A * | 7/1988 | Takeuchi et al. | 340/10.42 |
| 4,978,966 | A * | 12/1990 | Takizawa et al. | 343/788 |
| 6,400,330 | B1 * | 6/2002 | Maruyama et al. | 343/788 |
| 6,795,032 | B2 * | 9/2004 | Ieda et al. | 343/713 |
| 2003/0184489 | A1 * | 10/2003 | Maruyama et al. | 343/788 |

* cited by examiner

*Primary Examiner*—Tho Phan
(74) *Attorney, Agent, or Firm*—Christopher & Weisberg, P.A.

(57) ABSTRACT

A magnetic core antenna system including a magnetic core and a winding network. The winding network may be configured with a non-uniform ampere-turn distribution to achieve a desired flux density in the core. The network may include a plurality of windings configured to provide a winding impedance facilitating optimal transmitter power delivery to the windings. A magnetic core may be constructed from multiple components having longitudinal contact surfaces and joined by a transverse clamping force. An air gap may be provided between the components to allow relative movement therebetween.

11 Claims, 9 Drawing Sheets

HIGH EFFICIENCY CORE ANTENNA AND CONSTRUCTION METHOD

CROSS-REFERENCE TO RELATED APPLICATIONS

This application claims the benefit of U.S. Provisional Application Ser. No. 60/478,943, filed Jun. 16, 2003, the teachings of which applications are incorporated herein by reference.

FIELD OF THE INVENTION

The present invention relates to magnetic core antennas, and, in particular, to a high efficiency magnetic core antenna for use in a variety of systems such as an electronic article surveillance (EAS) or a radio frequency identification (RFID) system.

BACKGROUND

EAS and RFID systems are typically utilized to protect and track assets. In an EAS system, an interrogation zone may be established at the perimeter, e.g. at an exit area, of a protected area such as a retail store. The interrogation zone is established by an antenna or antennas positioned adjacent to the interrogation zone. The antenna(s) establish an electromagnetic field of sufficient strength and uniformity within the interrogation zone. EAS markers are attached to each asset to be protected. When an article is properly purchased or otherwise authorized for removal from the protected area, the EAS marker is either removed or deactivated.

If the EAS marker is not removed or deactivated, the electromagnetic field causes a response from the EAS marker in the interrogation zone. An antenna acting as a receiver detects the EAS marker's response indicating an active marker is in the interrogation zone. An associated controller provides an indication of this condition, e.g., an audio alarm, such that appropriate action can be taken to prevent unauthorized removal of the item.

An RFID system utilizes an RFID marker to track articles for various purposes such as inventory. The RFID marker stores data associated with the article. An RFID reader may scan for RFID markers by transmitting an interrogation signal at a known frequency. RFID markers may respond to the interrogation signal with a response signal containing, for example, data associated with the article or an RFID marker ID. The RFID reader detects the response signal and decodes the data or the RFID marker ID. The RFID reader may be a handheld reader, or a fixed reader by which items carrying an RFID marker pass. A fixed reader may be configured as an antenna located in a pedestal similar to an EAS system.

It is advantageous in both EAS and RFID systems to establish a sufficiently strong and uniform magnetic field within the interrogation zone in order to provide for reliable marker detection. To provide such a magnetic field, magnetic core antennas have been utilized. A magnetic core antenna typically includes a long core of magnetic material over which a winding is disposed. The winding includes a conductor such as a wire conductor or copper ribbon that is uniformly disposed about the length of the core to form a coil. The coil, which is an inductive element, may be connected to a discrete capacitor to form a resonant circuit. When a transmitter is connected to this resonant circuit, current flows through the winding generating a magnetic field in the core and in the region around the core antenna.

The magnetic field induced in the core material by the current flowing through the winding increases proportionately with the current level through the winding and the number of turns of the winding (ampere-turns). The magnetic field intensity that projects outside the core, e.g., into the interrogation zone of an EAS system, is a function of the intensity of the magnetic field in the magnetic core and the distribution of the magnetic field along the length of the core. However, the intensity of the magnetic field in the magnetic core tends to decrease at the end portions of the core due to self-demagnetization of the core. This results in a decrease in the utilization of the core, and, consequently, a lower magnetic field about the core of the antenna.

Also, maximum field generation from an antenna occurs when the ampere-turns delivered to the antenna core is maximized. The ampere-turns associated with a particular antenna may be adjusted by adding or subtracting turns from the antenna winding. High power antennas typically require a low number of turns. In many situations, however, it becomes impractical to reduce the number of turns due to physical limitations in achieving good coupling to large core structures with a low number of turns. Therefore, an impedance transforming device, e.g., a transformer, is often utilized between the transmitter and the antenna. The impedance transforming device is, however, an additional and expensive component. When the impedance transforming device is a transformer, additional problems may occur such as the introduction of additional resonant tank circuits with magnetizing inductance of the transformer in the equivalent circuit and the generation of high voltage spikes in the transformer secondary.

In addition, magnetic core antenna assemblies have been constructed with magnetic materials such as ferrite or powdered iron. For shorter core antenna lengths, the cores may be molded or pressed as a single piece. However for longer core antenna lengths, it is difficult to manufacture cores in a single piece. Hence, such longer core antennas are typically constructed by stacking smaller core components in an end-to-end fashion to achieve a desired length. A longitudinal clamping force is then applied to the two ends of the core assembly. As the length of the core assembly increases, the longitudinal clamping force necessarily increases creating greater stress on the core components.

In such longer core assemblies, it is desirable to minimize air gaps between the contacting surfaces of the individual core components so that the magnetic flux can pass from one high permeability core component to another without crossing a low permeability air gap. Minimizing such air gaps between the contacting surfaces of the core components helps to maintain minimum reluctance of the core assembly. When utilized in an EAS system, this helps the core antenna assembly to achieve a high magnetic field in the interrogation zone.

Such air gaps between the contacting surfaces of the individual core components can be caused by mechanical stresses that cause the core antenna assembly to bend from its original straight position. Since the core components are typically brittle materials, e.g., ceramic magnetic materials, such stress forces can result in damage, e.g., chipping, to the core material at the comers of the end to end joints causing air gaps. This can occur during shipping and installation of such core assemblies.

Accordingly, there is a need for a high efficiency magnetic core antenna. There is also a need for an apparatus and method of controlling the impedance of a core antenna for maximizing power transfer to the antenna without a separate impedance transforming device. There is a further need for a core assembly and construction method to provide improved core component coupling to overcome the above deficiencies in the prior art.

SUMMARY OF THE INVENTION

According to one aspect of the invention, there is provided a magnetic core antenna system including a magnetic core and a winding network. The magnetic core has a first section and a second section along a length thereof. The winding network includes at least one winding and has a first concentration of ampere-turns around the first section a second concentration of ampere-turns around the second section, the first concentration being greater than the second concentration. The winding network may include a plurality of windings configured to present a combined winding impedance within a predetermined range to optimize power delivery from a transmitter. Also, the core may be configured from separate core elements having longitudinal surfaces that are forced against each other by a transverse clamping force.

A method of making a core antenna for an EAS or RFID system is also provided. The method includes providing a core having a first section and a second section along a length thereof; and placing a winding network on the core, the winding network including a first concentration of ampere-turns around the first section and a second concentration of ampere-turns about the second section, the first concentration being greater than the second concentration.

According to another aspect of the invention, there is provided a magnetic core antenna system including a transmitter having a transmitter impedance and a magnetic core antenna. The magnetic core antenna includes a plurality of windings disposed along a length of the magnetic core antenna configured to present a combined winding impedance to the transmitter. The combined winding impedance is within a predetermined range of an optimal value for maximum power delivery from the transmitter. A method of optimizing power transfer from a transmitter to an associated magnetic core antenna is also provided. The method includes configuring a plurality of coils along a length of the magnetic core antenna to present a combined winding impedance level to the transmitter, the combined winding impedance level within a predetermined range of an optimal value for maximum power delivery from the transmitter.

According to another aspect of the invention, there is provided a magnetic core assembly including a plurality of core components configured in an end-to-end relationship. The core components may include a first core component having a first longitudinal surface, and a second core component having a second longitudinal surface. At least a portion of the first longitudinal surface contacts at least a portion of the second longitudinal surface at a longitudinal contact surface area between the first core component and the second core component. A method of making a magnetic core antenna is also provided. The method includes: positioning a first longitudinal surface of a first core component proximate a second longitudinal surface of a second core component; and forcing at least a portion of the first longitudinal surface against at least a portion of the second longitudinal surface to form a longitudinal contact surface area between the first core component and the second core component.

BRIEF DESCRIPTION OF THE DRAWINGS

For a better understanding of the present invention, together with other objects, features and advantages, reference should be made to the following detailed description which should be read in conjunction with the following figures wherein like numerals represent like parts.

DETAILED DESCRIPTION

For simplicity and ease of explanation, the present invention will be described herein in connection with various exemplary embodiments thereof associated with EAS systems. A core antenna consistent with the present invention may, however, be used in connection with an RFID or other system. It is to be understood, therefore, that the embodiments described herein are presented by way of illustration, not of limitation.

Figure 1:
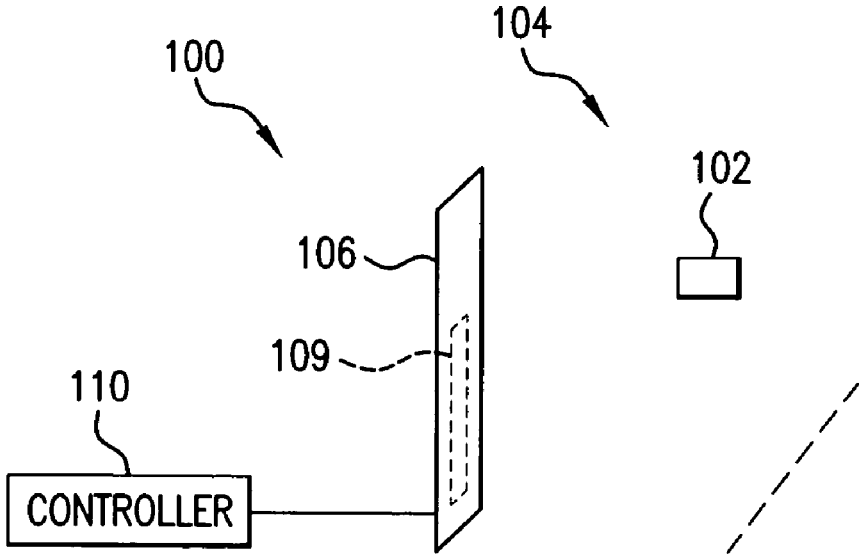
FIG. 1 is a schematic illustration of an exemplary EAS system including a magnetic core antenna consistent with the invention.

Turning to FIG. 1, there is illustrated an EAS system 100 including a core antenna 109 consistent with the invention. The EAS system 100 generally includes a controller 110 and a pedestal 106 for housing the core antenna 109. The controller 110 is shown separate from the pedestal 106 for clarity but may be included in the pedestal housing. In the exemplary embodiment of FIG. 1, the antenna 109 is configured as a transceiver and the associated controller 110 includes proper control and switching to switch from transmitting to receiving functions at predetermined time intervals. Those skilled in the art will recognize that there may be a separate transmitting antenna and receiving antenna located on separate sides of the interrogation zone 104.

An EAS marker 102 is placed on each item or asset to be protected. If the marker is not removed or deactivated prior to entering an interrogation zone 104, the field established by the antenna will cause a response from the EAS marker 102. The core antenna 109 acting as a receiver will receive this response, and the controller 110 will detect the EAS marker response indicating that the marker is in the interrogation zone 104.

Figure 2:
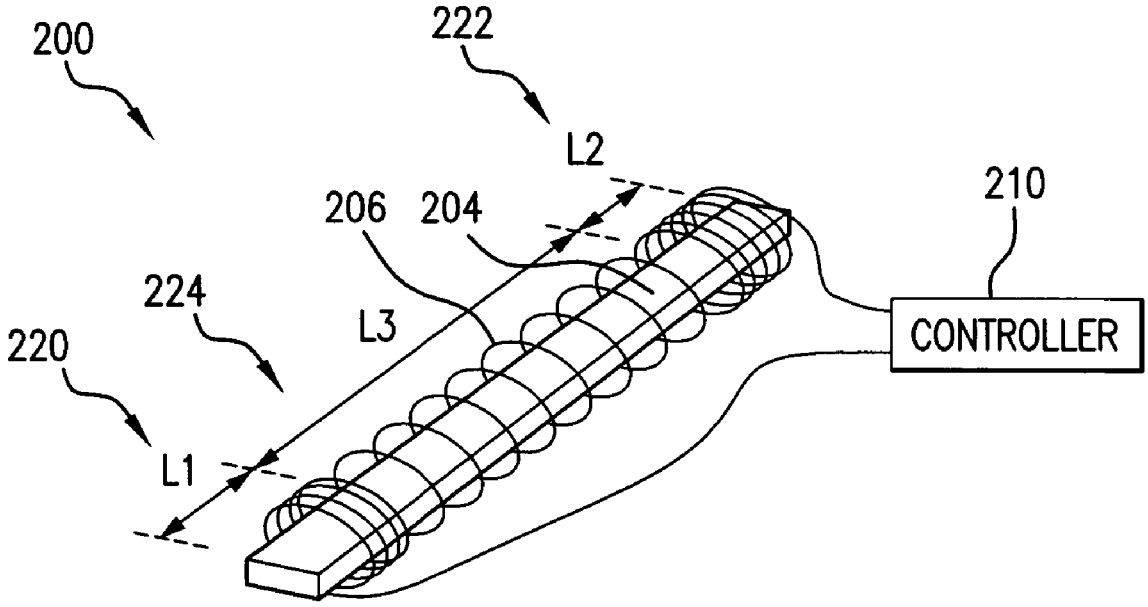
FIG. 2 is a perspective view of an exemplary magnetic core antenna consistent with the invention having a non-uniform winding distribution for improved core utilization.

FIG. 2 illustrates an exemplary core antenna 200 that may be utilized as the core antenna 109 in the EAS system of FIG. 1. The magnetic core antenna 200 generally includes a core 204 surrounded by a winding network. The core may be constructed from a variety of materials known in the art, such as ferrite and amorphous magnetic material.

The core may also be constructed from a nanocrystalline material, as described in U.S. patent application No. 10/745,128, the disclosure of which is incorporated herein by reference. A nanocrystalline core antenna may include a plurality of ribbons of nanocrystalline material laminated together with suitable insulation coatings. As will be recognized by those skilled in the art, nanocrystalline material begins in an amorphous state achieved through rapid solidification techniques. After casting, while the material is still very ductile, a suitable coating such as $SiO_2$ may be applied to the material. This coating remains effective after annealing and prevents eddy currents in the laminate core. The material may be cut to a desired shape and bulk annealed to form the nanocrystalline state. The resulting nanocrystalline material exhibits excellent high frequency behavior up to the RF range, and is characterized by constituent grain sizes in the nanometer range. The term "nanocrystalline material" as used herein refers to material including grains having a maximum dimension less than or equal to 40 nm. Some materials have a maximum dimension in a range from about 10 nm to 40 nm.

Exemplary nanocrystalline materials useful in a nanocrystalline core antenna include alloys such as FeCuNbSiB, FeZrNbCu, and FeCoZrBCu. These alloys are commercially available under the names FINEMET, NANOPERM, and HITPERM, respectively. The insulation material may be any suitable material that can withstand the annealing conditions, since it is preferable to coat the material before annealing. Epoxy may be used for bonding the lamination stack after the material is annealed. This also provides mechanical rigidity to the core assembly, thus preventing mechanical deformation or fracture. Alternatively, the nanocrystalline stack may be placed in a rigid plastic housing.

The winding network may include one or more coils, e.g., coil 206, coupled to the controller 210. When the controller 210 is acting as a transmitter, the controller provides an excitation signal, e.g., a drive current, to the coil 206. Advantageously, the winding network has a non-uniform distribution about the length of the core 204 in order to more efficiently utilize the magnetic core 204. For instance, in one embodiment, the core 204 may have a first end 220 having length L1 a second end 222 having length L2 and a center section 224 having length L3 disposed between the first 220 and second 222 end of the core. The coil 206 may have a first ampere-turn concentration about the first end 220 of the core 204 that is greater than its ampere-turn concentration about the center portion 224 of the core. Similarly, the coil 206 may also have a second ampere-turn concentration about the second end 222 of the core that is greater than its concentration about the center portion 224 of the core.

Advantageously, the ampere-turn concentrations along the length of the core can be configured to achieve a desired or maximized magnetic flux density distribution along the core length. The required difference between ampere concentrations on portions of the core to achieve a desired or maximized magnetic flux distribution depends on system characteristics such as available transmitter power, core material and dimensions, impedance at the core, etc. Generally, for a particular system, the ampere-turns established by the windings may be adjusted iteratively until a desired or maximized flux density is achieved.

In one embodiment, the ampere-turn concentration at the first end and the concentration at the second end may be substantially equal to provide greater utilization of the core at the respective ends 220, 222 of the core, and the ampere turn concentration at the first and second ends may be at least 10% greater than the concentration at the center section. In another embodiment, the windings may establish a continuously variable ampere-turn concentration along the length of the core. Various other non-uniform winding configurations to achieve a desired magnetic flux density may be provided.

Figure 3:
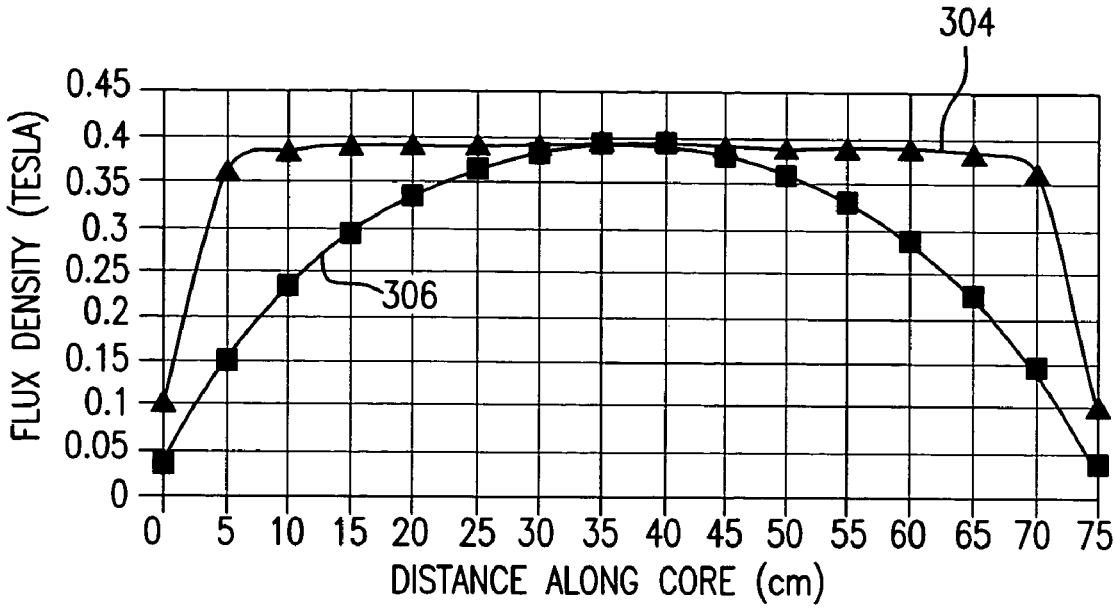
FIG. 3 is a plot of flux density versus distance along an exemplary core consistent with the invention illustrating an improved distribution of flux density along the core compared to a conventional core antenna.

FIG. 3 illustrates an exemplary plot 304 of magnetic flux density distribution along the length of an exemplary core antenna consistent with the invention having a non-uniform distribution of coil windings about its length, as illustrated for example in FIG. 2. As shown, the exemplary core antenna is 75 cm long and advantageously has a relatively consistent flux density about its length. For example, in plot 304 the flux density from 5 to 70 cm along the length of the core varies only between about 0.35 and 0.4 Tesla.

Plot 306 illustrates magnetic flux density along a conventional core of similar length having uniform winding distribution. As shown, the flux density in plot 306 peaks at about 0.4 Tesla for the center of the core between about 35 cm and 45 cm and falls off sharply thereafter on both ends compared to the plot 304. For example, at one end (10 cm distance along the core) the flux density of the conventional core has fallen to less than 0.25 Tesla while the flux density of the core consistent with the invention is almost 0.4 Tesla. Accordingly, the ends of the core antenna consistent with the invention are more fully utilized so that the energy from an associated transmitter is spread out more evenly across the core length.

Figure 4:
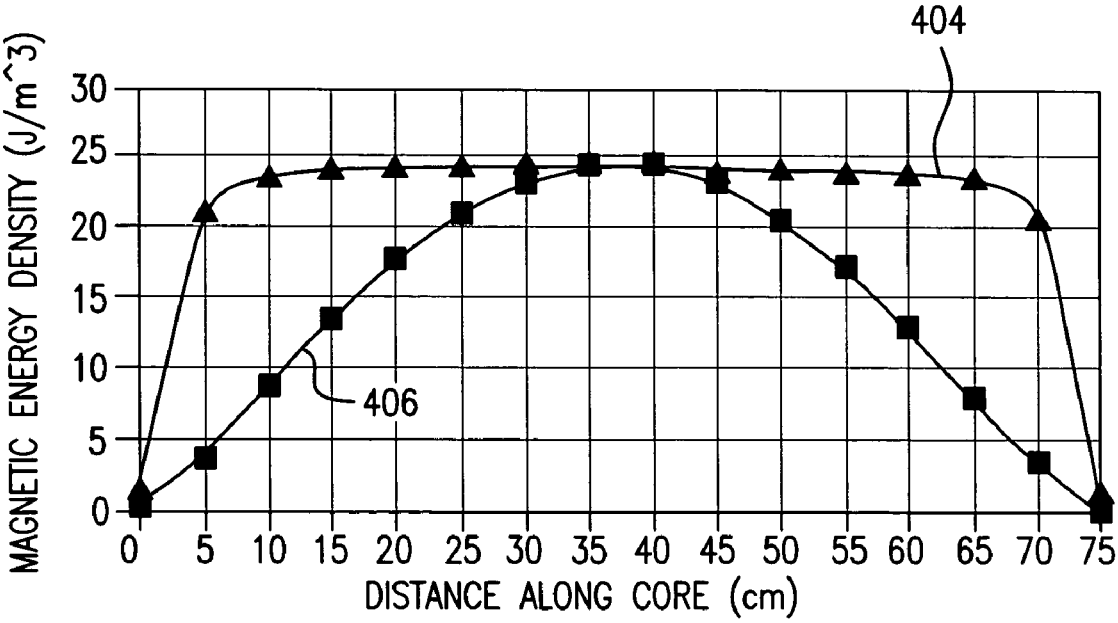
FIG. 4 is a plot of magnetic energy density versus distance along an exemplary core consistent with the invention illustrating an improved increase in magnetic field energy in the core compared to a conventional core antenna.

The difference in flux distribution, as illustrated in FIG. 3, is associated with an increase in magnetic field energy stored in the core, as illustrated in FIG. 4. Plot 404 of the magnetic energy density over the length of the core consistent with the invention reveals a 50% increase in energy stored in the core compared to plot 406 of the magnetic energy density over the length of a conventional core with a uniform winding distribution. In addition, the magnetic energy density level in plot 404 is relatively consistent about the length of the core, as opposed to the magnetic energy density level of plot 406, which falls off rapidly from the center towards the ends of the core.

Figure 5:
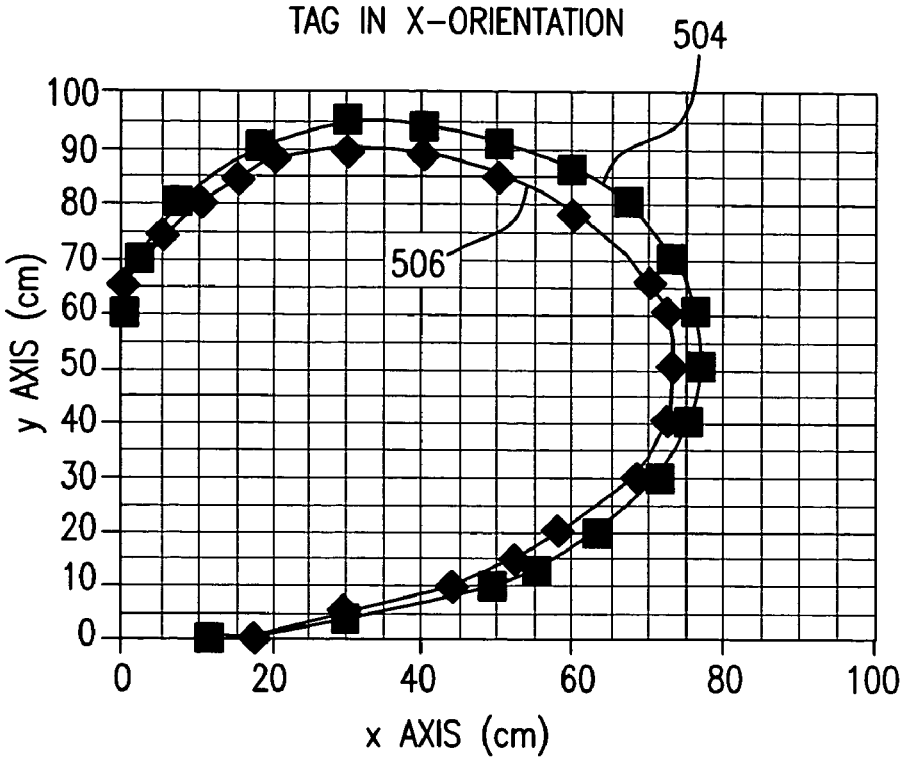
FIG. 5 is a plot of the detection range of a core antenna consistent with the invention compared to a conventional core antenna with a tag oriented in an x-direction.
Figure 6:
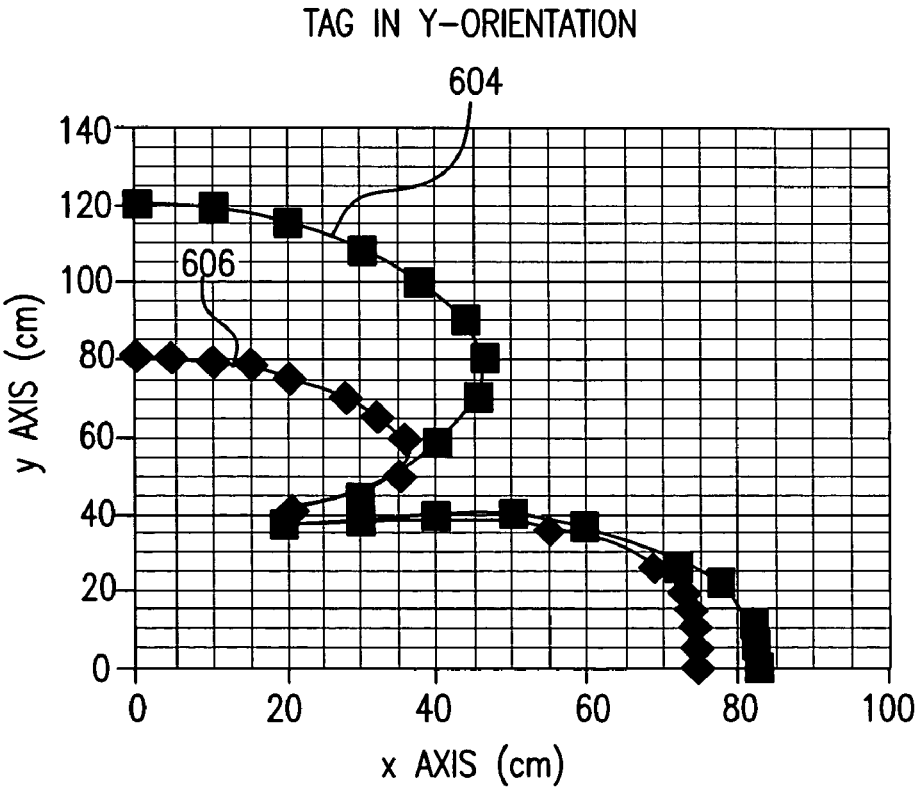
FIG. 6 is a plot of the detection range of a core antenna consistent with the invention compared to a conventional core antenna with a tag oriented in a y-direction.

The uniformity of flux distribution and field density exhibited by a magnetic core antenna consistent with the invention is associated with an increase in detection range when the antenna is used in systems such as EAS or RFID systems. For example, FIG. 5 illustrates a plot 504 of the detection range for a tag orientated in a horizontal x-orientation for an antenna consistent with the invention. In contrast, plot 506 illustrates a lesser detection range for a tag oriented in a similar direction for a conventional antenna with a uniform coil distribution having otherwise substantially the same attributes (e.g., core length, core material, and current drive level). Similarly, FIG. 6 illustrates a plot 604 of the detection range for a tag oriented in a lateral y-direction for an antenna consistent with the invention as compared to a plot 606 of the detection range for the conventional antenna. The detection range for an antenna consistent with the invention with the tag in the y-orientation is greater than the range associated with a conventional antenna.

Since the core material is driven more efficiently in an antenna consistent with the invention, the amount of magnetic material in the core necessary to provide a given magnetic field may be reduced, e.g. by 20% or more. This reduces the cost, size, and weight of the core antenna necessary to provide a given magnetic field. On the other hand, various considerations such as cost, size, or weight may limit the amount of magnetic material in the core to a predetermined amount. With such a limited amount, a stronger more uniform magnetic field can be obtained with an antenna consistent with the invention as opposed to a conventional antenna. This is because the saturation flux density of a core material establishes an upper limit to how hard a predetermined core size may be driven by the transmitter. Driving the core flux density above this level is undesirable since it causes harmonic distortion in the transmit field.

Impedance Optimization

For current limited transmitters such as used in some EAS and RFID systems, the transmitter will deliver its maximum power when the impedance of the subsequent load, e.g. the transmitting antenna, is adjusted high enough to support maximum output voltage of the transmitter without exceeding its current limit. The impedance of a core antenna is, at least in part, proportional to the square of the number of turns of the winding about the core, and depends on the material core loss, which is both frequency and field level dependent. High power antennas require very low impedances and, therefore, a low number of turns. However, its becomes impractical to sufficiently reduce the number of turns in most situations due to physical limitations in achieving good coupling to large core structures. Therefore, the impedance of the coil in such situations often becomes too high to be driven efficiently by the transmitter.

Figure 7:
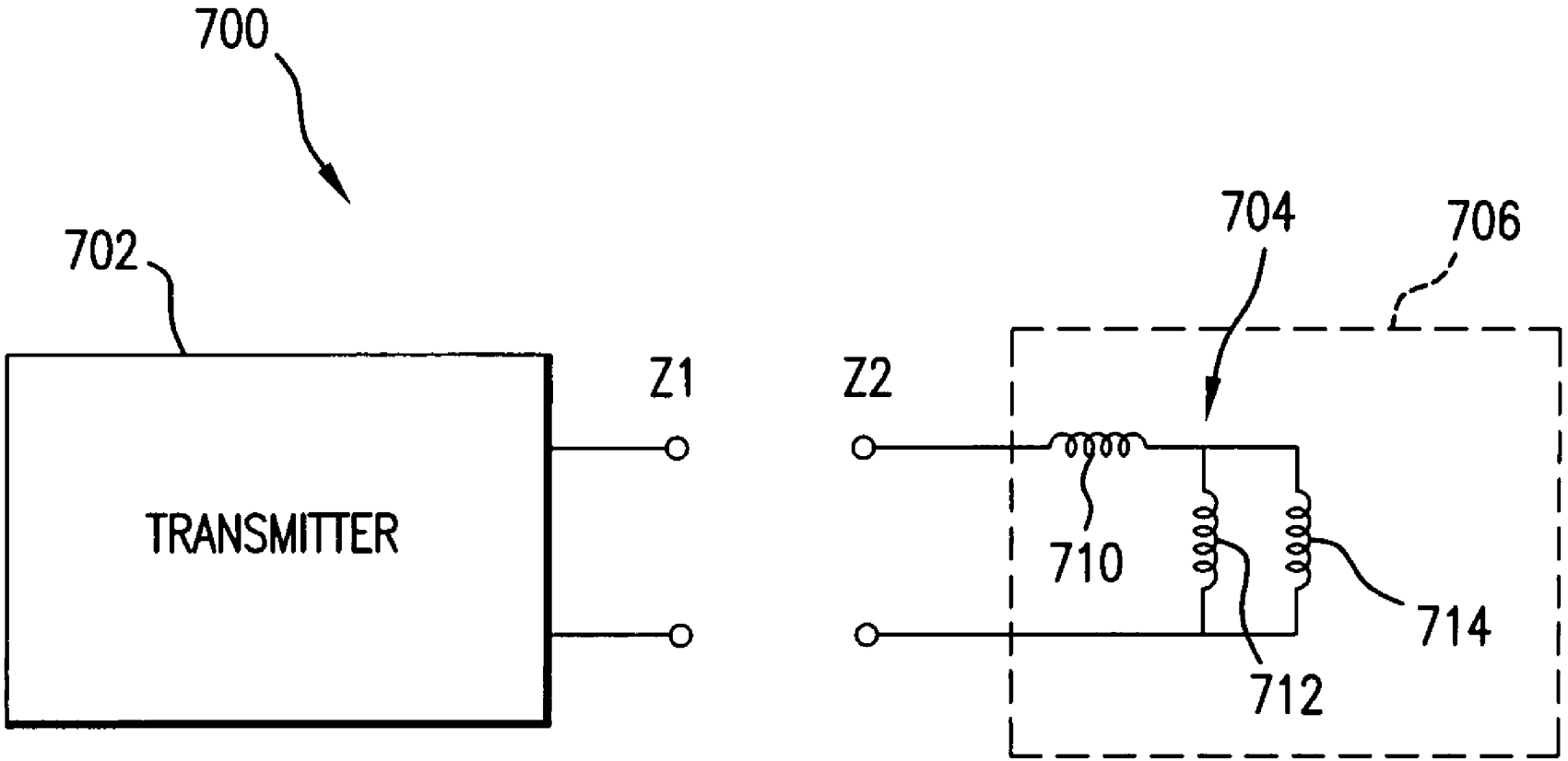
FIG. 7 is a block diagram of a transmitter coupled directly to a core antenna having a plurality of windings providing a combined impedance for optimizing power transfer from the transmitter.

Turning to FIG. 7, a block diagram of a magnetic core antenna system 700 including a transmitter 702 configured to provide a driving current to a coil network 704 of a core antenna 706 is illustrated. Consistent with the present invention, power delivery from the transmitter 702 may be optimized by adjusting the impedance Z of the core antenna 706 to a level resulting in a maximum output voltage from the transmitter 702 without exceeding the transmitter current limit. This can be accomplished in a manner that does not require use of a separate impedance transforming device such as a transformer. In particular, the impedance Z may be adjusted by selecting, locating, and coupling a plurality of coils, e.g., coils 710, 712, 714, about the core until the transmitter power delivery is optimized. Although achieving optimal power delivery has significant advantages, any desired level of power delivery from the transmitter to the antenna may be achieved by establishing an associated impedance level Z through selective orientation of the coils.

The impedance level Z may be established by arranging and combining a plurality of coils in a variety of fashions. For example, the location of each individual coil around the core may be adjusted to change the mutual coupling between the coils. The number of turns for each coil may also be adjusted by adding or subtracting turns to increase or decrease the impedance level associated with each coil. The coupling of various coils may also be adjusted by various combinations of serial or parallel coupling. The impedance level Z can thus be established at a low level in high power antenna application for optimum power delivery from the transmitter, even if one or more individual coils has a relatively high resonant impedance. Of course, those of ordinary skill in the art will recognize that the coil configuration required to optimize the impedance Z for a particular antenna depends on system characteristics such as available transmitter power, core characteristics and dimensions, etc.

Advantageously, a core antenna consistent with the invention may be designed having either an optimum flux density across the length of the core, or the desired resonant impedance for optimum power transfer from the transmitter, or both. If both are combined on a single antenna, a maximum magnetic field strength from the antenna can be generated in the interrogation zone.

A variety of antenna embodiments may be constructed in accordance with the principles of the present invention to achieve both optimum flux density and power transfer from the transmitter. One embodiment may utilize one or more secondary windings and primary windings. The secondary windings, or portions of the secondary windings, may be passive secondary windings which are indirectly coupled via the antenna core to the primary windings. The primary windings, or portions of the primary windings, may be driven directly by an associated transmitter. The primary windings, the secondary windings, or some combination thereof may be connected in various series or parallel combinations and their turns adjusted to achieve both high intensity flux distribution about the core and optimum transmitter power delivery. In addition, one or more resonant capacitors may be wired across individual or combinations of passive secondary windings.

One embodiment may include only a primary and secondary winding. The secondary winding may be connected to a capacitor to form a resonant circuit. The primary and/or the secondary winding may have its turns distributed non-uniformly about the core, as previously detailed, to achieve a desired flux density distribution about the core length. In addition, the number of primary turns and the primary-to-secondary turns ratio could be used to set the combined impedance level to an appropriate value so that maximum power transfer from the transmitter may be obtained.

Additional embodiments include, but are not limited to: 1) multiple primary windings connected in series or parallel combinations and with a single resonant secondary winding; and 2) multiple primary windings connected in either series or parallel combinations and multiple secondary windings wired in either series or parallel combinations or resonated independently. In each instance, the primary and second windings may be connected electrically to form a common winding. A portion of the combined winding may be driven by the transmitter acting as a primary winding and another portion may be acting as a secondary winding even though they are connected.

Figure 8:
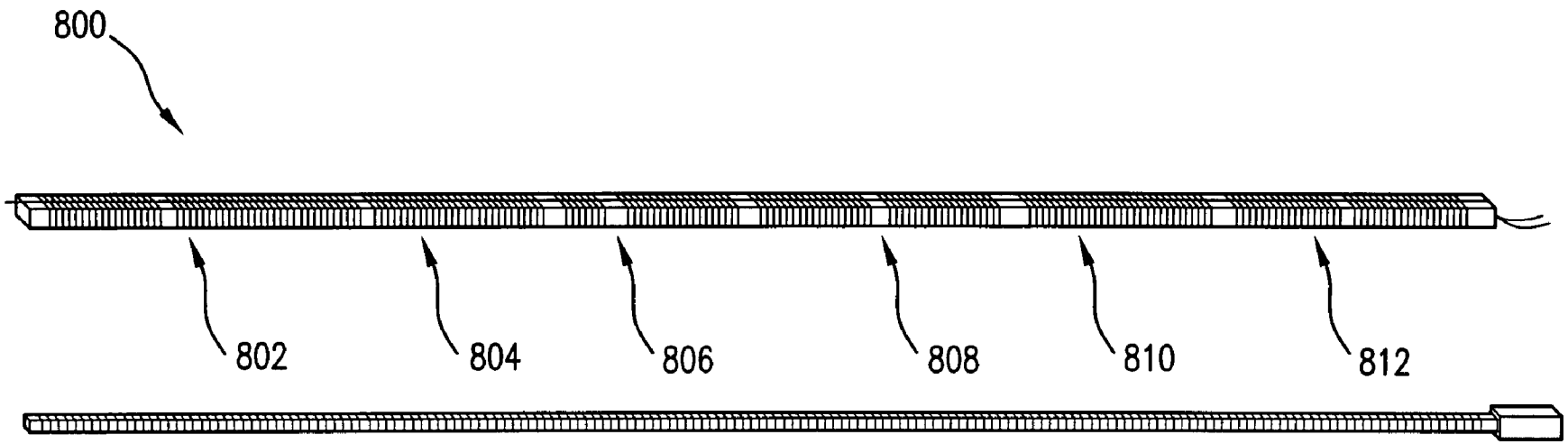
FIG. 8 is a perspective view an exemplary core antenna consistent with the invention having six windings disposed about the length of the core and coupled in parallel.

FIG. 8 illustrates one exemplary embodiment of a core antenna 800 consistent with the invention. The exemplary core antenna 800 may be suitable for high power applications such as may be used on wide exit passage ways in an EAS system. Wide exit passageways are typically at least 2.0 meters wide, with 4.0 to 5.0 meters being a typical distance. Multiple antennas may be configured, e.g. with multiplexing, etc., to cover very wide openings of, for example, 40 ft or more. The illustrated exemplary core antenna utilizes six independent windings 802, 804, 806, 808, 810, 812, where each is coupled in parallel with the others to achieve combined low impedance for optimal power transfer. In addition, the position of the windings and the turns for each winding distribute the magnetic flux in the core for optimum field generation.

Figure 9:
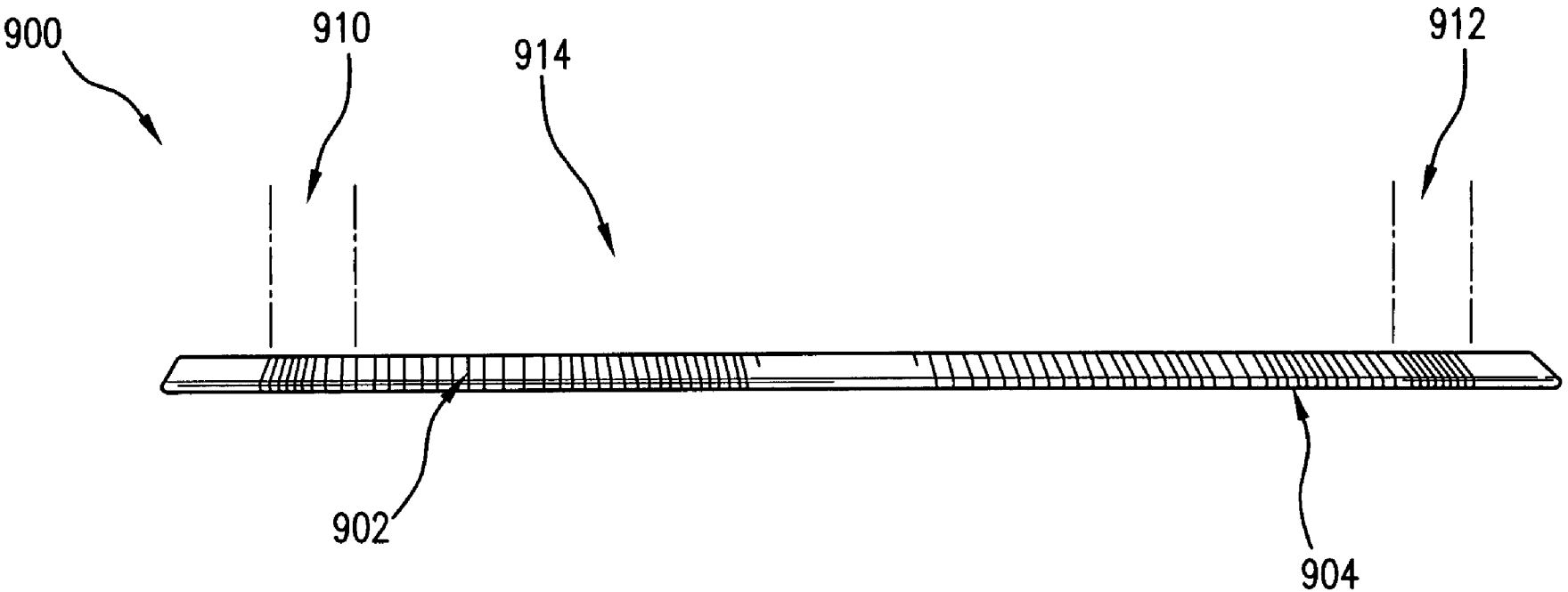
FIG. 9 is a perspective view of another exemplary core antenna consistent with the invention having two independent windings connected to separate transmitter channels.

FIG. 9 illustrates another exemplary embodiment of a core antenna 900 consistent with the invention. The antenna 900 includes two independent windings 902, 904. Each winding has a non-uniform distribution of turns as earlier detailed. In this instance, each winding has fewer ampere turns in the center section 914 of the core and a larger concentration of ampere-turns on the ends 910, 912 of the core. This non-uniform winding distribution results in a relatively consistent flux density about the length of the core providing better core utilization, particularly at the ends 910, 912 of the core. In addition, the two independent windings 902, 904 may be connected to a separate transmitter channel with their impedance set for optimum power transfer.

Core Construction Assembly

Figure 10A:
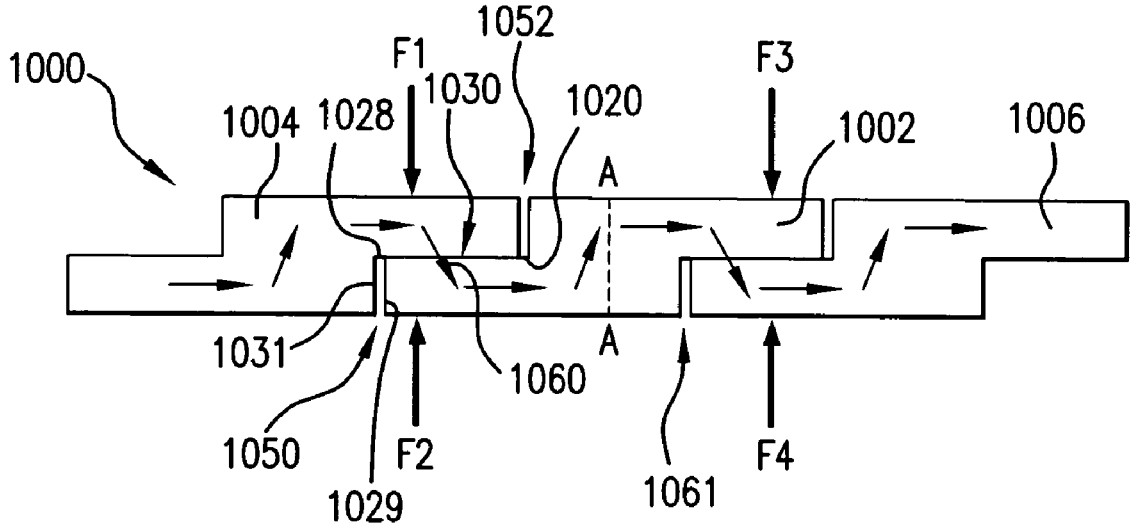
FIG. 10A is a top view of one embodiment of a magnetic core assembly having a plurality of core components to be joined in a manner consistent with the invention.

An antenna consistent with the invention may be constructed from a plurality of solid magnetic material core components connected end-to-end. Turning to FIG. 10A, for example, a top view of one embodiment of a magnetic core assembly 1000 consistent with the invention is illustrated. The magnetic core assembly 1000 may include a plurality of core components 1002, 1004, 1006. Although three core components 1002, 1004, 1006 are illustrated, any number of core components may be utilized to achieve an overall desired length of the core assembly 1000. For ease of explanation, only the configuration and orientation of first core component 1002 and second core component 1004 are detailed herein. The other core components may be similarly configured and oriented.

The first core component 1002 may have a first longitudinal surface 1020 substantially parallel to a lengthwise axis of the antenna, and the second core component 1004 may have a second longitudinal surface 1028 substantially parallel to the lengthwise axis of the antenna. Advantageously, a portion of the first longitudinal surface 1020 may contact a portion of the second longitudinal surface 1028 to form a contact surface area 1030 between the first core component 1002 and the second core component 1004. Transverse clamping forces F1 and F2 may then be applied by any variety of mechanical means known in the art to maintain contact between the first 1002 and second 1004 core component at the longitudinal contact surface area 1030.

Advantageously, the longitudinal contact surface area 1030 may be of a suitably large size with close mating to enable magnetic flux to easily cross the contact surface area 1030 as indicated by arrow 1060. In one embodiment, the longitudinal contact surface area 1030 may be made much larger than a typical cross sectional area that would otherwise be utilized in an end-end contact arrangement between core components. For example, the longitudinal contact surface area 1030 may greater than or equal to the cross-sectional area taken along line A—A of the first core component 1002.

In addition, air gaps 1050, 1052 may advantageously be formed between the first 1002 and second 1004 core components. Such air gaps may be dimensioned to permit relative movement between the core components without damaging the contact surface portion 1030. The air gap 1050, for example, may have a width defined by the surface 1029 of the first core component 1002, the surface 1031 of the second core component and the relative position of the first 1002 and second 1004 core component. Air gap 1052 may similarly be formed between the first 1002 and second 1004 core component. In one embodiment, the air gap may be at least 0.1 mm.

Figure 10B:
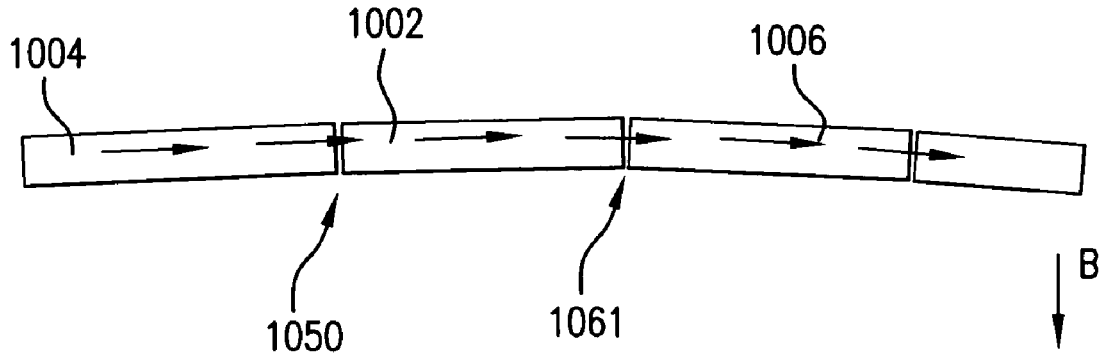
FIG. 10B is a side view of the embodiment of FIG. 10A bending in one direction.

Turning to FIG. 10B, a side view of the core assembly 1000 of FIG. 10A is illustrated. As the core assembly 1000 is bent generally in a direction indicated by arrow B the air gaps 1050, 1052 provide clearance to allow relative movement between the first 1002 and second 1004 core components. The air gaps may be dimensioned to that upon such relative movement, the surface 1029 of the first core component 1002 does not contact the surface 1031 of the second core component 1004. Physical damage to the core components 1002, 1004 caused by bending of the core assembly may thereby be eliminated or reduced.

Transverse clamping forces may be applied to secure each core component of the core assembly to each adjacent core component. For example, transverse clamping forces F1 and F2 clamp the first core component 1002 to the second core component 1004 and transverse clamping forces F3 and F4 clamp the first core component 1002 to the third core component 1006. A variety of simple mechanical means known in the art may be utilized to provide such transverse clamping forces. In addition, the transverse clamping force may be much less than the longitudinal clamping force used in conventional core antennas in an end-to-end assembly. This greatly reduces the stress applied to the core components and helps to minimize the damage to brittle core components.

Figure 11A:
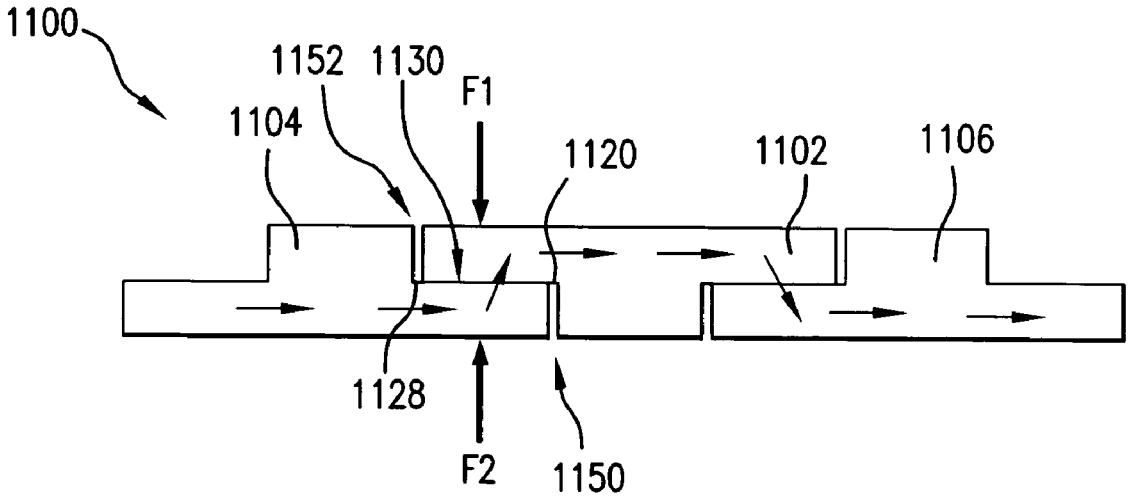
FIG. 11A is a top view of another embodiment of a magnetic core assembly having a plurality of core components to be joined in a manner consistent with the invention.
Figure 11B:
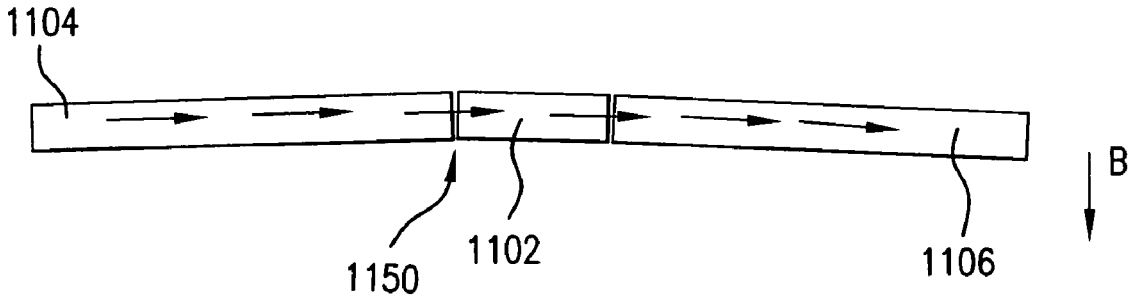
FIG. 11B is a side view of the embodiment of FIG. 11A bending in one direction.

FIGS. 11A and 11B illustrate a top and side view, respectively, of another core assembly 1100 embodiment consistent with the invention. The core assembly 1100 includes three core components 1102, 1104, 1106. As with the embodiment of FIGS. 10A and 10B, the first core component 1102 may have a first longitudinal surface 1120 while the second core component 1104 may have a second longitudinal surface 1128. A portion of the first longitudinal surface 1120 may contact a portion of the second longitudinal surface 1128 to form a contact surface area 1130 between the first core component 1102 and the second core component 1104. Transverse clamping forces F1 and F2 may then be applied by any variety of mechanical means known the art to maintain contact between the first 1102 and second 1104 core component at the longitudinal contact surface area 1130.

The longitudinal contact surface area 1130 may be of a suitably large size with close mating to enable magnetic flux to easily cross the contact surface area 1130. Air gaps 1150, 1152 may be formed by the relative placement of the first 1102 and second 1104 core component. As discussed above, the air gaps reduce or eliminate physical damage to the core components 1102, 1104 caused by bending of the core assembly, e.g. in the direction indicated by arrow B in FIG. 11B.

Figure 12A:
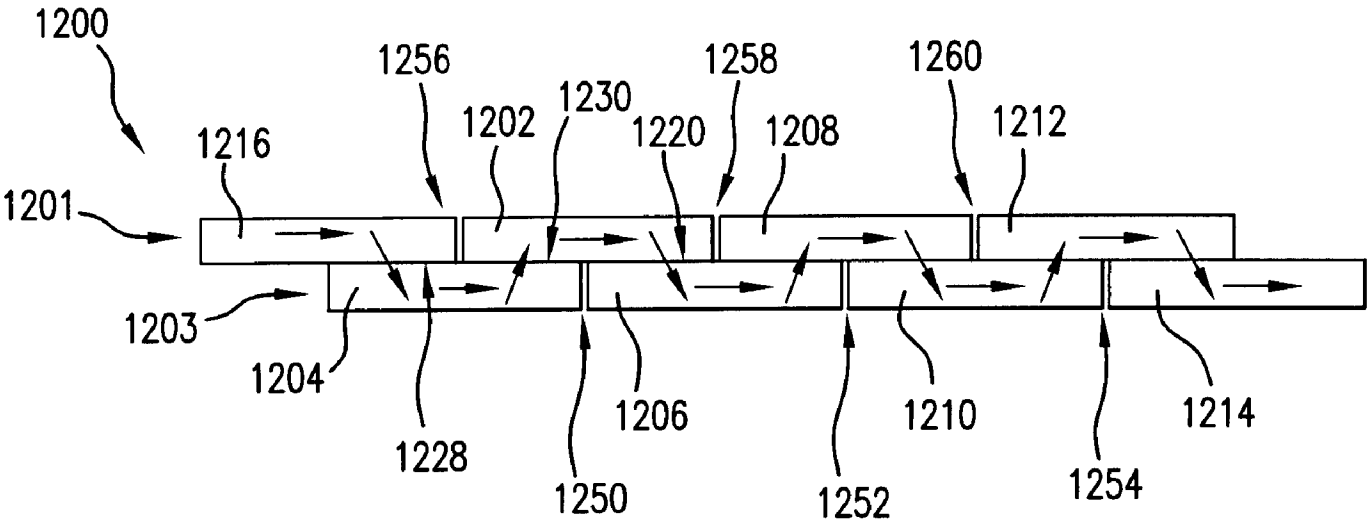
FIG. 12A is a top view of yet another embodiment of a magnetic core assembly consistent with the invention having two rows of core components to be joined in a manner consistent with the invention.
Figure 12B:
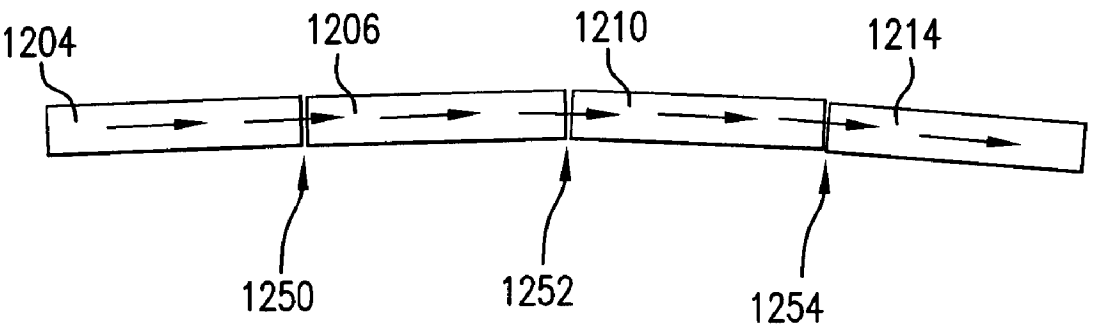
FIG. 12B is a side view of the embodiment of FIG. 12A bending in one direction.

FIGS. 12A and 12B illustrate a top and side view, respectively, of another core assembly 1200 embodiment consistent with the invention. The core assembly 1200 includes a first row 1201 of core components 1216, 1202, 1208, and 1212 configured in an end-to-end relationship and a second row 1203 of core components 1204, 1206, 1210, and 1214 configured in an end-to-end relationship. Each core component of each row may contact at least one associated core component of the other row at a contact surface area. For example, a first core component 1202 may have a longitudinal surface 1220, and a second core component 1204 may have a second longitudinal surface 1228. A portion of the first longitudinal surface 1220 may contact a portion of the second longitudinal surface 1228 to form a contact surface area 1230 between the first core component 1202 and the second core component 1204. The longitudinal contact surface area 1230 may be of a suitably large size with close mating to enable magnetic flux to easily cross the contact surface area 1230.

In addition, the core components of each row 1201, 1203 may be separated to create a plurality of air gaps 1250, 1252, 1254, 1256, 1258, 1260. The air gaps may be dimensioned to permit relative movement between the components of each row without causing physical damage to the core components, as illustrated in the side view of FIG. 12B. In one embodiment, the air gaps in each row may be at least 0.1 mm. Also, the air gaps in each row may be spanned the core components of the other row, as shown.

The embodiments that have been described herein, however, are but some of the several which utilize this invention and are set forth here by way of illustration but not of limitation. It is obvious that many other embodiments, which will be readily apparent to those skilled in the art, may be made without departing materially from the spirit and scope of the invention as defined in the appended claims.

What is claimed is:

1. A magnetic core antenna system comprising:

a magnetic core having a first section and a second section along a length thereof; and a winding network including at least one winding, said winding network having a first concentration of ampere-turns around said first section a second concentration of ampere-turns around said second section, said first concentration being greater than said second concentration, said system further comprising a transmitter for driving said winding network, and wherein said winding network comprises a plurality of said windings configured to present a combined winding impedance to said transmitter, said combined winding impedance being selected for establishing a desired power transfer from said transmitter to said winding network, wherein at least one of said plurality of windings has an impedance level greater than said combined winding impedance.

2. A magnetic core antenna system comprising:

a magnetic core having a first section and a second section along a length thereof, said magnetic core comprising a plurality of core components configured in an end-to-end relationship, said plurality of core components form a first row of core components, and wherein said magnetic core comprises a second plurality of core components configured in an end-to-end relationship to form a second row of core components positioned adjacent to said first row of core components, wherein each of said core components of said first row contacts at least one associated one of said core components of said second row, wherein said core components of said first row are spaced from each other to define at least one first row air gap, and wherein said core components of said second row are spaced from the each other to define at least one second row air gap; and a winding network including at least one winding, said winding network having a first concentration of ampere-turns around said first section a second concentration of ampere-turns around said second section, said first concentration being greater than said second concentration.

3. The magnetic core antenna system of claim 2, wherein said at least one first row air gap is spanned by an associated one of said core components of said second row, and wherein said at least one second row air gap is spanned by an associated one of said core components of said first row.

4. The magnetic core assembly of claim 2, wherein said at least one first row air gap is dimensioned to permit relative movement between said core components of said first row, and said at least one second row air gap is dimensioned to permit relative movement between said core components of said second row.

5. The magnetic core assembly of claim 4, wherein said at least one first row air gap and said at least one second row air gap is at least 0.1 mm.

6. A magnetic core antenna system comprising:

a magnetic core having a first section and a second section along a length thereof, wherein said magnetic core comprises:

a first core component having a first longitudinal surface; and a second core component having a second longitudinal surface, wherein at least a portion of said first longitudinal surface contacts at least a portion of said second longitudinal surface at a longitudinal contact surface area between said first core component and said second core component, wherein a transverse clamping force is applied to said first and second core components to force said portion of said first longitudinal surface against said portion of said second longitudinal surface; and a winding network including at least one winding, said winding network having a first concentration of ampere-turns around said first section a second concentration of ampere-turns around said second section, said first concentration being greater than said second concentration.

7. A method of making a core antenna for an EAS or RFID system, said method comprising:

providing a core having a first section and a second section along a length thereof, said core comprising a plurality of core components configured in an end-to-end relationship, said plurality of core components forming a first row of core components, said core comprising a second plurality of core components configured in an end-to-end relationship to form a second row of core components positioned adjacent to said first row of core components, wherein each of said core components of said first row contacts at least one associated one of said core components of said second row, wherein said core components of said first row are spaced from each other to define at least one first row air gap, and wherein said core components of said second row are spaced from the each other to define at least one second row air gap; and placing a winding network on said core, said winding network comprising a first concentration of ampere-turns around said first section and a second concentration of ampere-turns about said second section, said first concentration being greater than said second concentration.

8. The method of claim 7, wherein said at least one first row air gap is spanned by an associated one of said core components of said second row, and wherein said at least one second row air gap is spanned by an associated one of said core components of said first row.

9. The method of claim 7, wherein said at least one first row air gap is dimensioned to permit relative movement between said core components of said first row, and said at least one second row air gap is dimensioned to permit relative movement between said core components of said second row.

10. The method of claim 9, wherein said at least one first row air gap and said at least one second row air gap is at least 0.1 mm.

11. A method of making a core antenna for an EAS or RFID system, said method comprising:

providing a core having core having a first section and a second section along a length thereof, wherein said core comprises a plurality of core components configured in an end-to-end relationship, said plurality of core components comprising:

a first core component having a first longitudinal surface; and a second core component having a second longitudinal surface, wherein at least a portion of said first longitudinal surface contacts at least a portion of said second longitudinal surface at a longitudinal contact surface area between said first core component and said second core component, wherein a transverse clamping force is applied to said first and second core components to force said portion of said first longitudinal surface against said portion of said second longitudinal surface; and placing a winding network on said core, said winding network comprising a first concentration of ampere-turns around said first section and a second concentration of ampere-turns about said second section, said first concentration being greater than said second concentration.

* * * * *